US008118313B2

(12) United States Patent
Lee

(10) Patent No.: US 8,118,313 B2
(45) Date of Patent: Feb. 21, 2012

(54) INFANTILE RIDING PLAYING NINE

(75) Inventor: Doo Pyeong Lee, Busan (KR)

(73) Assignee: Sung Shin Enc Co., Ltd., Incheon (KR)

( * ) Notice: Subject to any disclaimer, the term of this patent is extended or adjusted under 35 U.S.C. 154(b) by 275 days.

(21) Appl. No.: 12/663,691

(22) PCT Filed: Jul. 2, 2008

(86) PCT No.: PCT/KR2008/003884

§ 371 (c)(1),
(2), (4) Date: Dec. 8, 2009

(87) PCT Pub. No.: WO2009/005289

PCT Pub. Date: Jan. 8, 2009

(65) Prior Publication Data

US 2010/0190410 A1 Jul. 29, 2010

(30) Foreign Application Priority Data

Jul. 3, 2007 (KR) ..... 10-2007-0066464

(51) Int. Cl.
*A63G 17/00* (2006.01)

(52) U.S. Cl. ..... 280/1.13; 280/1.181; 280/1.182; 280/1.191; 280/1.192

(58) Field of Classification Search ..... 280/1.13
See application file for complete search history.

(56) References Cited

U.S. PATENT DOCUMENTS 1,502,838 A * 7/1924 Barber ..... 280/1.13
2,738,199 A * 3/1956 Rand ..... 280/1.182
3,096,990 A * 7/1963 Thoren ..... 280/1.182
3,229,995 A * 1/1966 Grieder ..... 280/218
3,423,105 A * 1/1969 Kerstholt et al. ..... 280/218
3,999,771 A * 12/1976 Lohr ..... 280/1.13

FOREIGN PATENT DOCUMENTS

| | | |
|---|---|---|
| JP | 9-313739 | 12/1997 |
| JP | 2001-120843 | 5/2001 |
| KR | 20-0179498 | 2/2000 |
| KR | 20-0300401 | 12/2002 |

* cited by examiner

*Primary Examiner* — Joanne Silbermann
*Assistant Examiner* — Michael Stabley
(74) *Attorney, Agent, or Firm* — IPLA P.A.; James E. Bame

(57) ABSTRACT

A riding apparatus for children is disclosed. The riding apparatus of the present invention includes a main body (110), which has a handle (111) and a footrest (115), and support plates (120), which are installed in the main body and are placed upright at positions spaced apart from each other by a predetermined distance. The riding apparatus further includes an operating unit (300), which has a front rotary member (330), a rear rotary member (340), a front spring (350), a rear spring (351) and a connection bar (310). The front rotary member and the rear rotary member respectively have interlocking shafts (213) and (223). The riding apparatus further includes front legs (210) and rear legs (220), which are respectively fastened to the interlocking shafts (213) and (223). A one-way wheel assembly is provided on the lower end of each of the front and rear legs.

6 Claims, 8 Drawing Sheets

[Fig. 1]
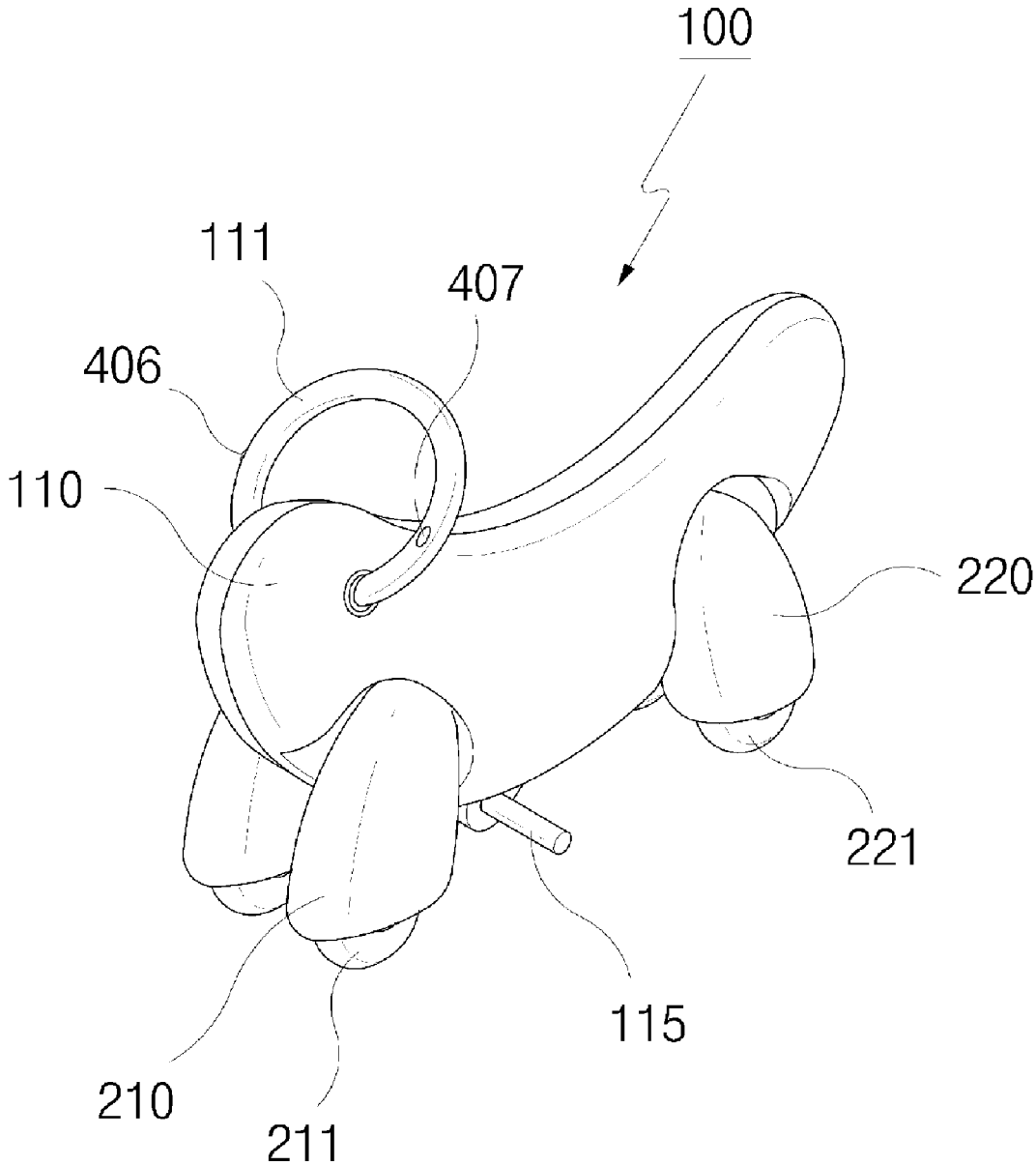

[Fig. 2]
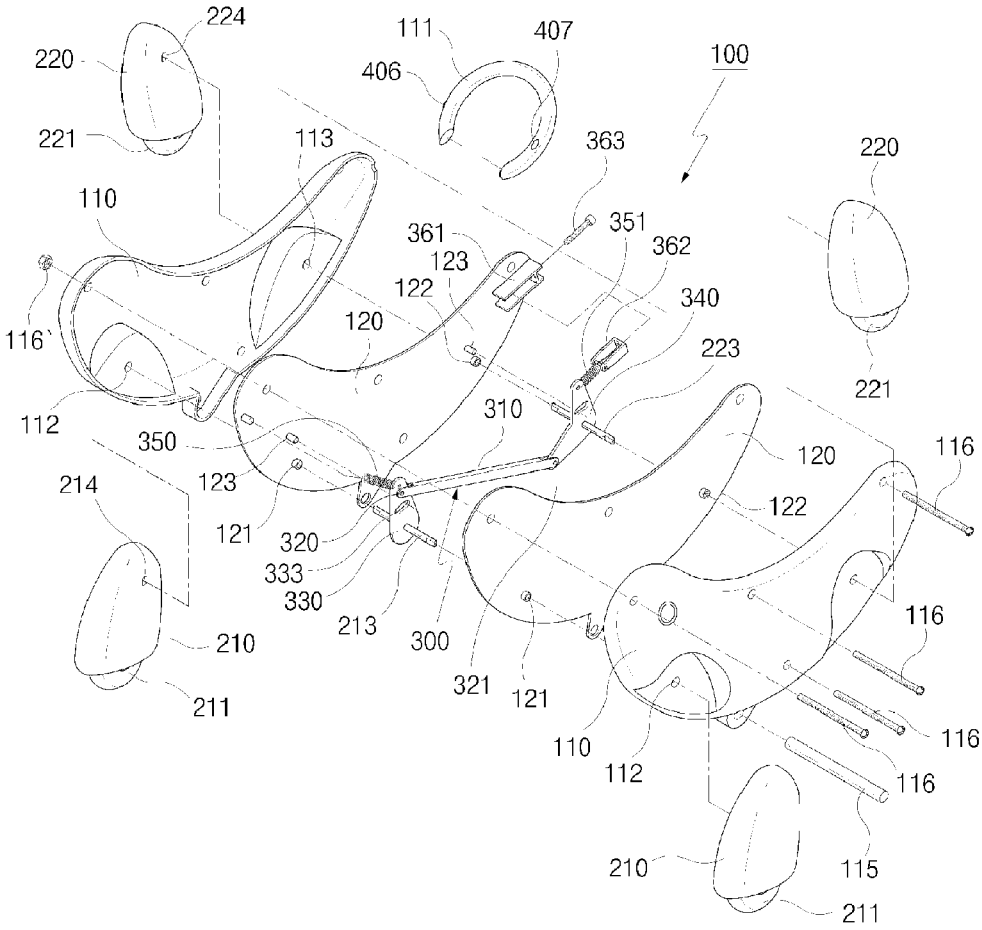
[Fig. 3]
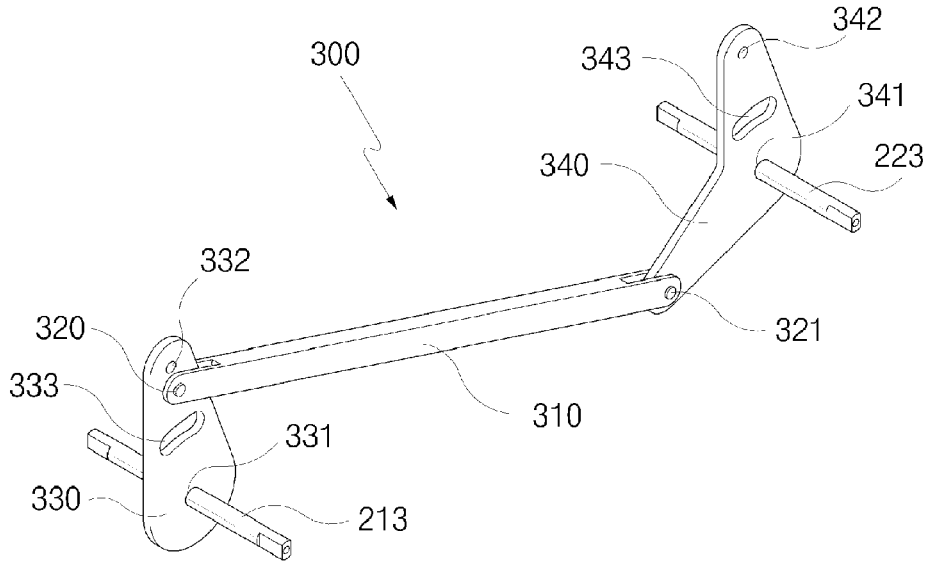

[Fig. 4]
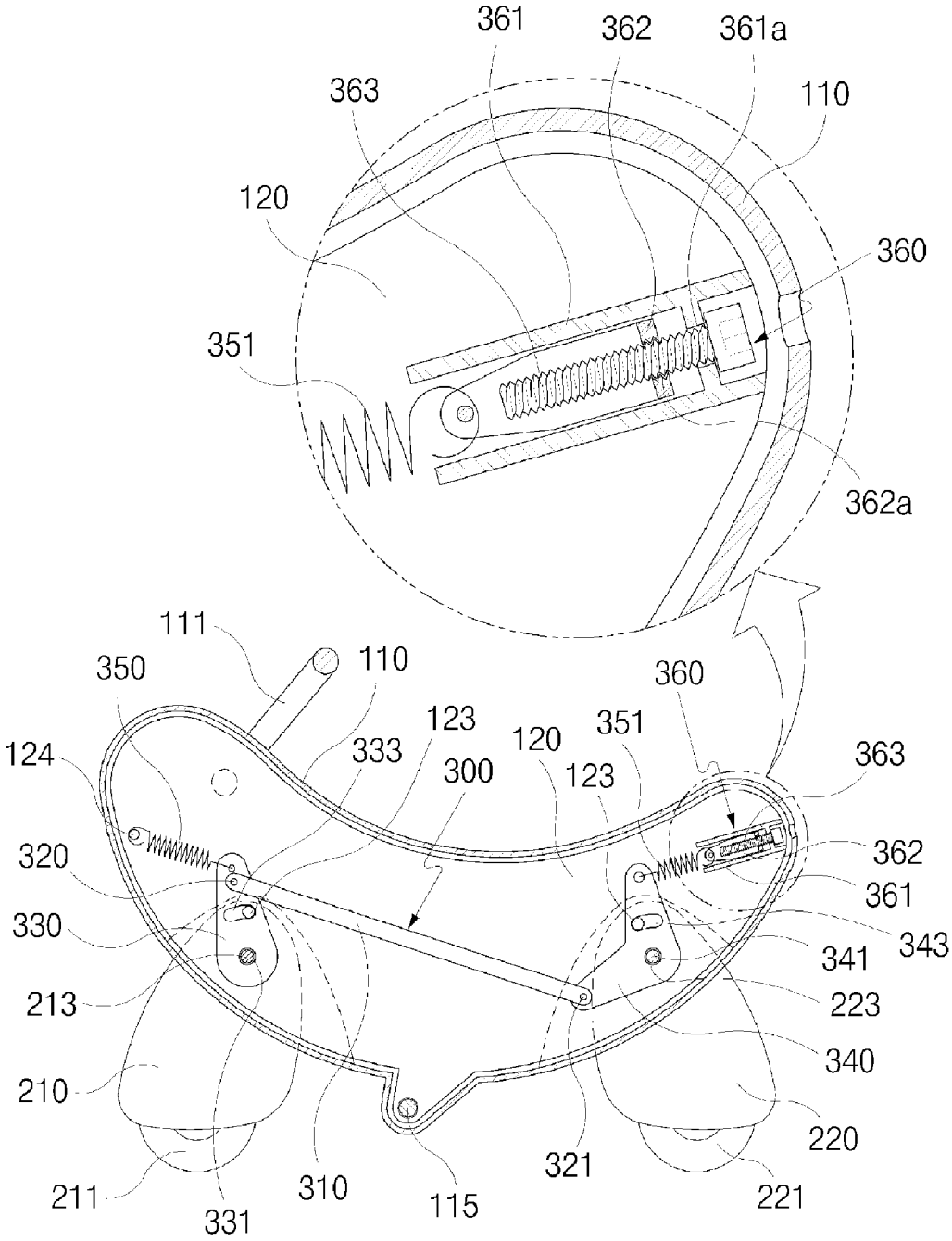

[Fig. 5]
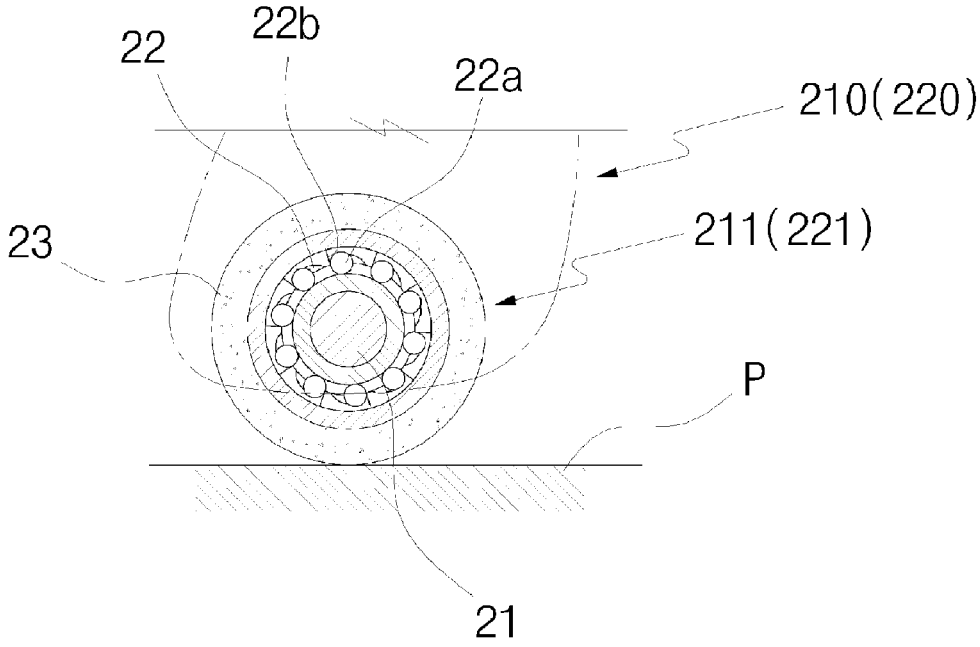
[Fig. 6]
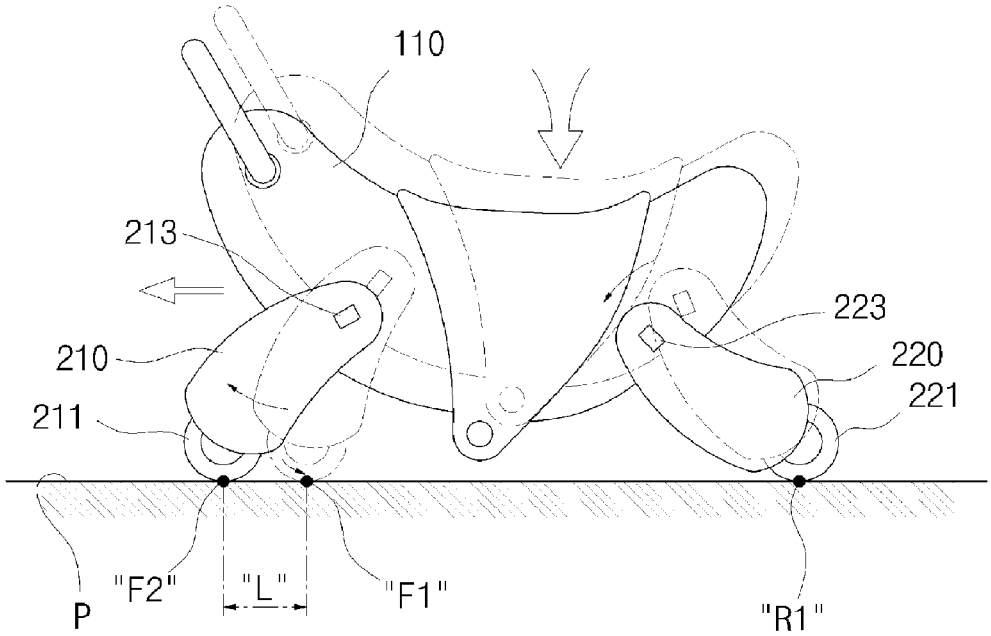

[Fig. 7]
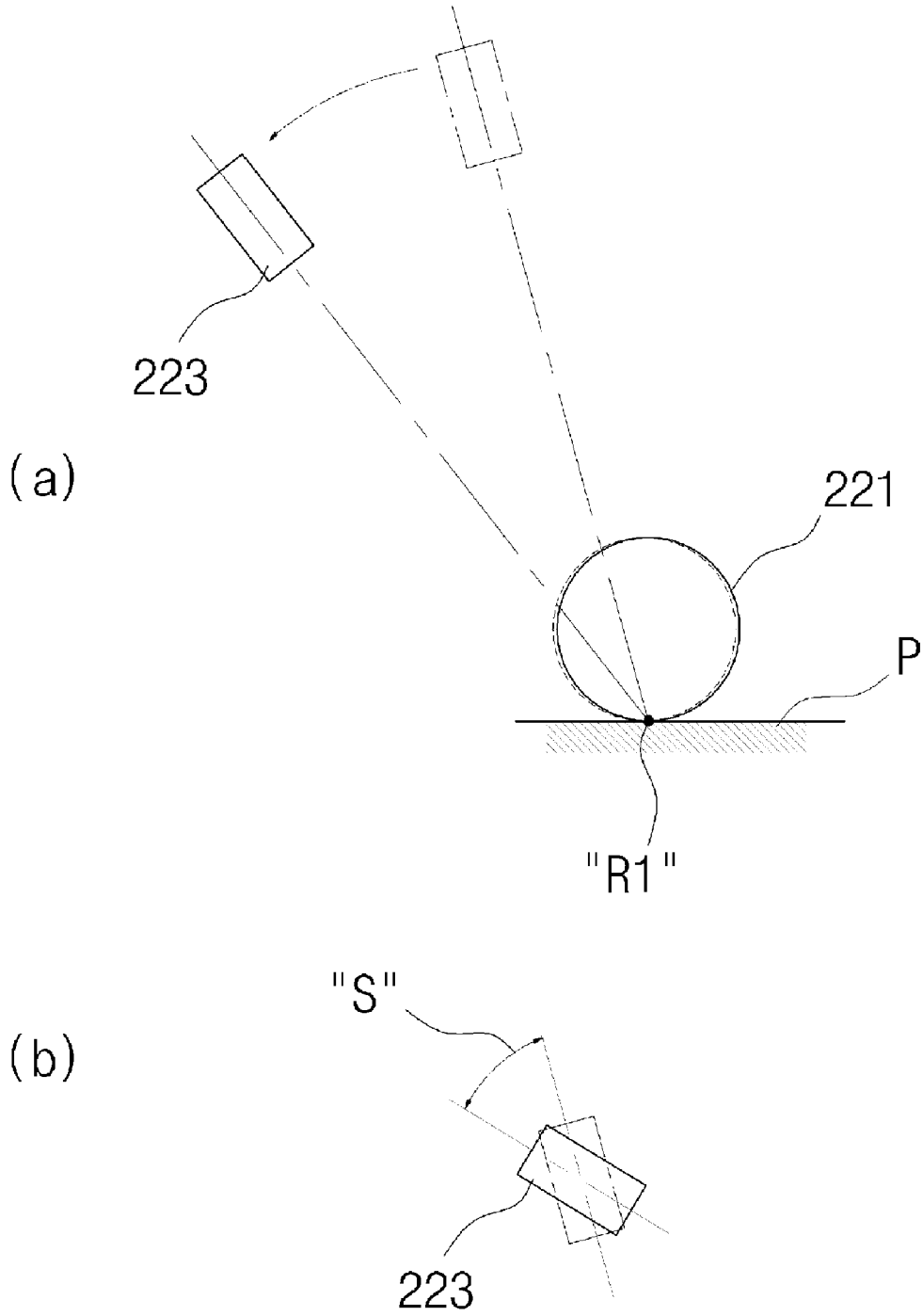

[Fig. 8]
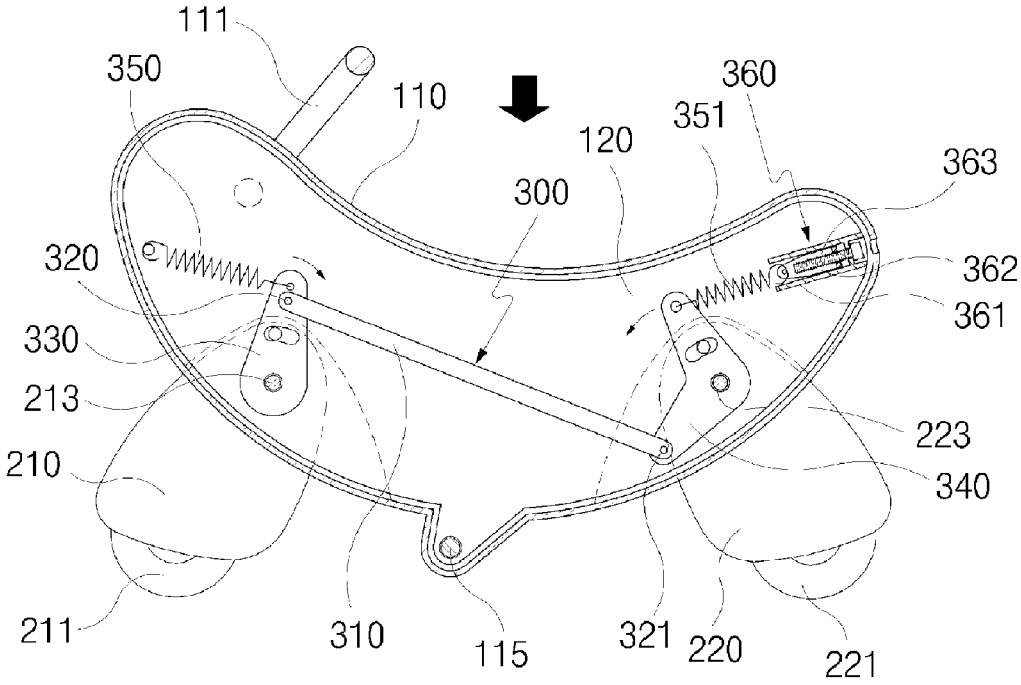
[Fig. 9]
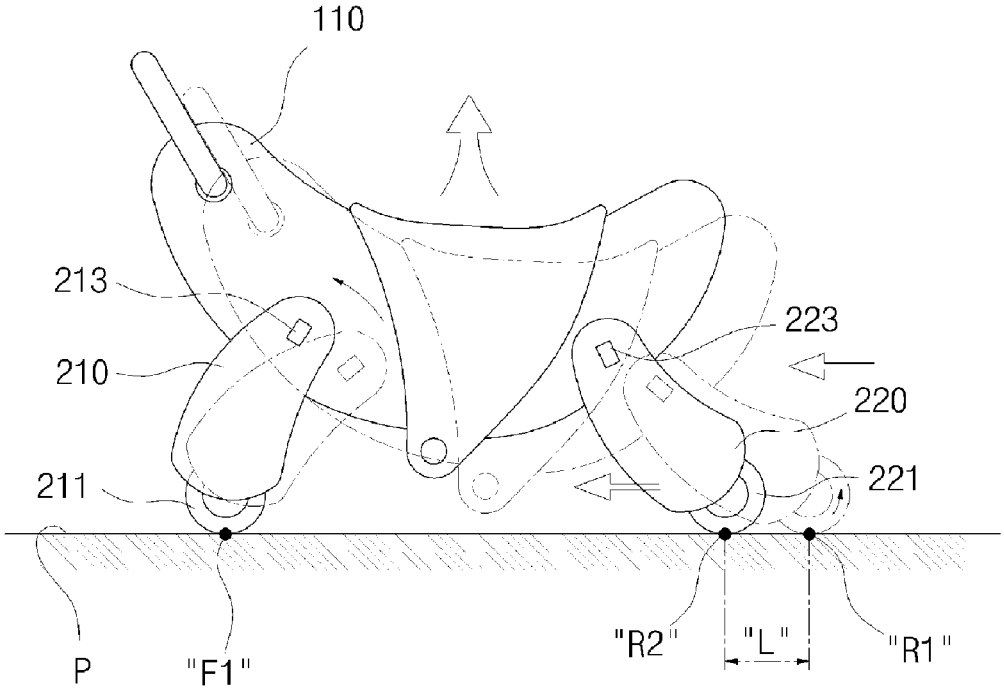

[Fig. 10]
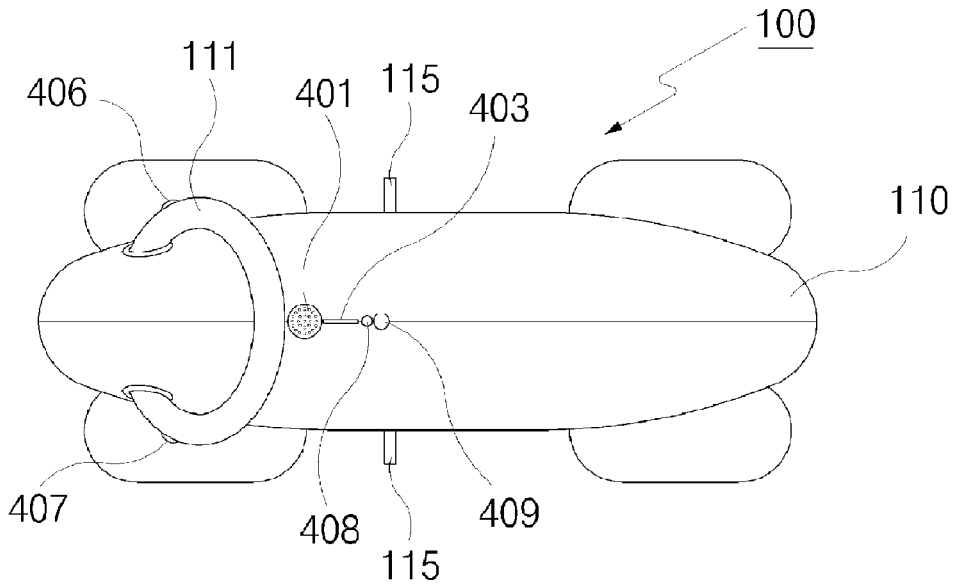
[Fig. 11]
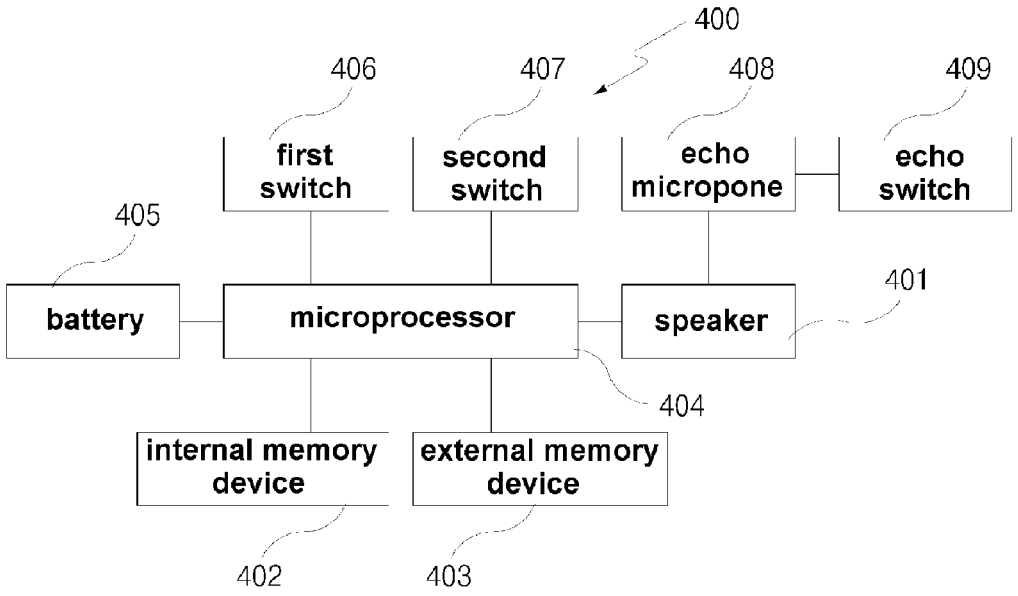

[Fig. 12]
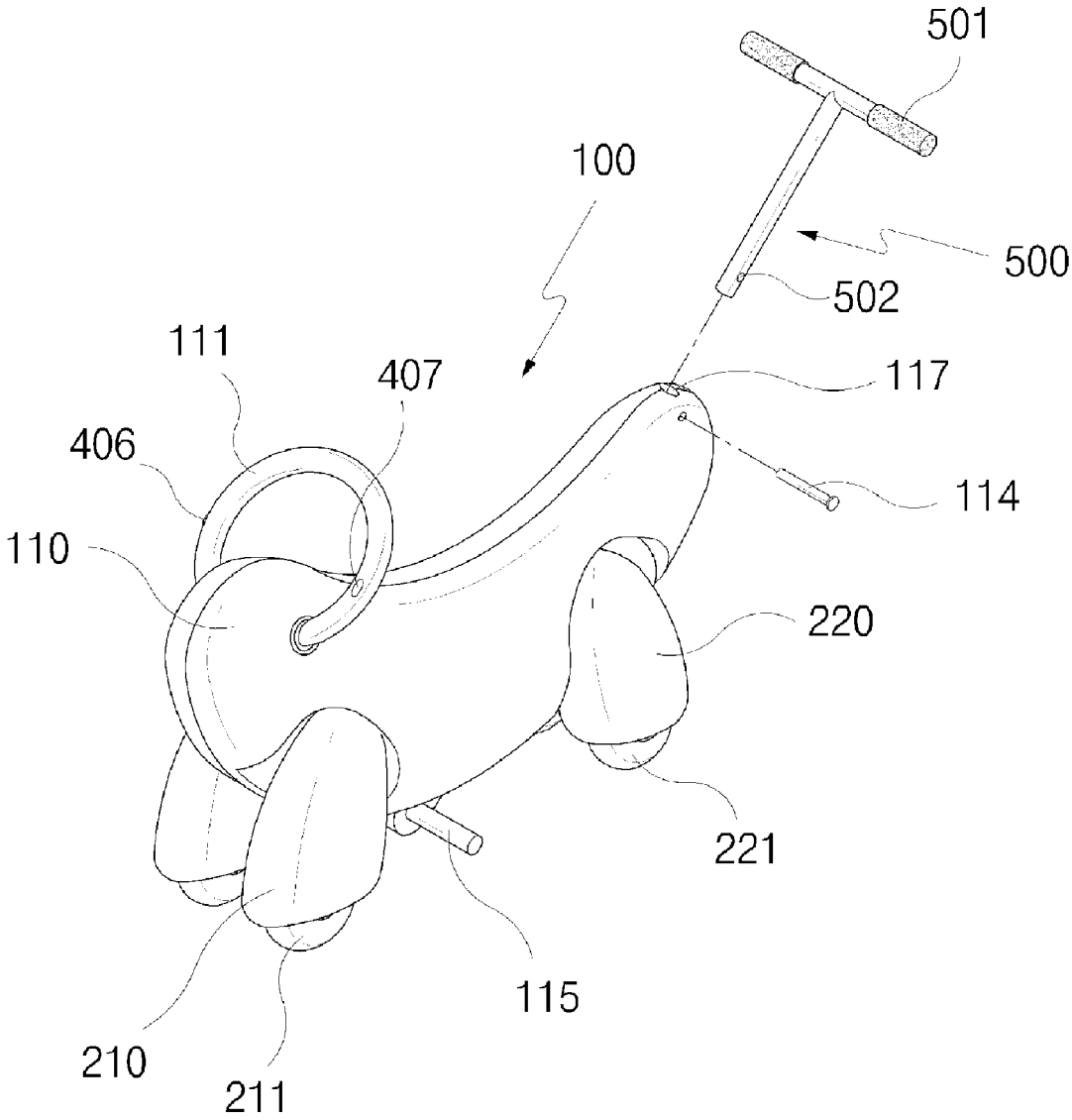

INFANTILE RIDING PLAYING NINE

TECHNICAL FIELD

The present invention relates, in general, to riding apparatuses for children and, more particularly, to a riding apparatus for children which is constructed such that when a main body of the riding apparatus is moved upwards and downwards by the stamping motion of a user sitting on the main body, legs of the riding apparatus are elastically swung, thus generating a propulsive force, thereby advancing the apparatus forwards, and which can prevent noise when the legs of the riding apparatus are swung, and is constructed such that front wheels and rear wheels precisely guide the apparatus.

BACKGROUND ART

[Reference document] KR 20-0340905 Y1 2004.02.11

DISCLOSURE OF INVENTION

Technical Problem

Generally, riding apparatuses for children include a main body having an animal shape such as that of a horse, an elephant, a dog, a tiger, etc., or a vehicular shape such as that of a motorcycle, a car, etc. Furthermore, wheels are provided under the front and rear portions of the main body. After a child user rides on the upper portion of such a riding apparatus, the user pushes the ground using his/her feet. Then, propulsive force is generated, so that the riding apparatus is advanced. Children are curious about movement of the riding apparatuses. In addition, the motion of advancing the riding apparatus develops the leg muscles of the child user. Because the child user tries to maintain balance while moving the riding apparatus, the muscles of the body of the child user can be evenly developed and the sense of balance can be improved.

However, the conventional riding apparatuses have no particular purpose, except for the operation in which a riding apparatus is advanced when a user who sits on the riding apparatus pushes the ground using his/her feet. Thus, children become relatively easily tired of the conventional riding apparatuses.

In an effort to overcome the above problems, a riding apparatus was proposed in Korean Utility Model Registration No. 340905, which was filed by the inventor of the present invention. In this riding apparatus, a main body is divided into front and rear body parts such that the two body parts are rotated with respect to each other by a hinge. A tensioning spring is connected between the two body parts. Wheels, which rotate only in directions in which the riding apparatus is advanced, are provided under the lower portion of each body part. When a user sitting on the main body moves his/her body upwards and downwards, the two body parts of the main body of the riding apparatus are rotated by the elastic force in directions in which they are folded and in directions in which they are unfolded. Thereby, propulsive force is generated, so that the riding apparatus is advanced.

However, in the case of the riding apparatus disclosed by the inventor of the present invention, because the main body is divided into front and rear body parts and the riding apparatus is operated such that the front and rear body parts are rotated with respect to each other, the user may feel a pain on his/her hips when the front and rear body parts are bent. Furthermore, because the front and rear body parts and the tensioning spring, which is connected therebetween, form a straight structure, when the two body parts are unfolded, the stability is reduced. While the riding apparatus is operated, a relatively large noise occurs due to expansion and contraction of the tensioning spring which is made of metal.

Moreover, the motion, in which the riding apparatus is advanced by generating a propulsive force, just momentarily stimulates the curiosity of children. That is, the function of the conventional riding apparatus is not enough to continuously satisfy the curiosity of children. Therefore, a riding apparatus having a larger variety of functions is required.

Technical Solution

Accordingly, the present invention has been made keeping in mind the above problems occurring in the prior art, and an object of the present invention is to provide a riding apparatus for children which can be advanced all the while maintaining the original shape of a main body without bending the main body on which a child sits, and which can induce a child, who is lacking in exercise, to exercise and use his/her muscles.

Another object of the present invention is to provide a riding apparatus for children which is constructed such that even if the user sitting on the main body shakes the main body forwards and backwards, the riding apparatus is normally operated without leaning to one side, and such that even if an excessive load is applied to the riding apparatus when the front and rear legs of the apparatus are stretched or contracted, the riding apparatus is resistant to the load and the main body can be prevented from being deformed, thus allowing for long-term use, thereby markedly enhancing the reliability of the product.

A further object of the present invention is to provide a riding apparatus for children which is constructed such that various kinds of sound information, such as the cry of an animal, the sound of horse's hooves, music, etc., can be output by manipulating switches.

In order to accomplish the above object, the present invention provides a riding apparatus for children, comprising: a main body having an animal or character shape, the main body being divided into two body parts manufactured through separated processes, the main body being formed by coupling the two body parts to each other, with a handle provided on an upper portion of a front end of the main body, and a footrest provided on a lower end of a medial portion of the main body; a plurality of support plates installed in the main body, the support plates being placed upright at positions spaced apart from each other by a predetermined distance; an operating unit, comprising: a front rotary member and a rear rotary member respectively having interlocking shafts, the interlocking shafts being respectively inserted into insert holes, which are formed at front and rear positions in the support plates and the main body, so that the front rotary member and the rear rotary member are respectively provided at front and rear positions between the support plates so as to be rotatable, with guide slots respectively formed in central portions of the front rotary member and the rear rotary member, so that stop protrusions, which are respectively provided at front and rear positions on an inner surface of one of the support plates, are inserted into the respective guide slots; a front spring for applying an elastic force to the front rotary member such that an upper end of the front rotary member is biased forwards; a rear spring for applying an elastic force to the rear rotary member such that an upper end of the rear rotary member is biased backwards; and a connection bar coupled to the upper end of the front rotary member and a lower end of the rear rotary member using hinge shafts, respectively; and a pair of front legs and a pair of rear legs respectively having shaft holes fitted over corresponding opposite ends of the interlocking shafts which extend outside the main body through the insert holes, with one-way wheel assemblies respectively provided on lower ends of the front legs and the rear legs, each of the one-way wheel assemblies being rotatable only in a forward direction, the front legs and the rear legs being swung in directions away from each other and in directions approaching each other.

The riding apparatus may further comprise a spring tension adjusting unit for adjusting a tension of the rear spring, which biases the upper end of the rear rotary member backwards, the spring tension adjusting unit including: a support member provided on an inner surface of one of the support plates, the support member having a stop piece therein; a tension adjusting movable body provided in the support member so as to be linearly movable, with a nut hole formed through a first end of the tension adjusting movable body, the tension adjusting movable body being coupled at a second end thereof to the rear spring; and a wrench bolt inserted into the stop piece and threaded into the nut hole, so that the tension adjusting movable body is linearly moved by rotating the wrench bolt, thus adjusting the tension of the rear spring.

Furthermore, a sound output unit may be provided in the upper portion of the front end of the main body. The sound output unit may include a speaker, an internal memory device, a removable external memory device, a microprocessor and a battery. A first switch for outputting sound information, stored in the internal memory device, and a second switch for outputting sound information, stored in the removable external memory device, may be respectively provided on opposite ends of the handle.

In addition, an echo microphone may be provided at a predetermined position in the main body to provide an echoing effect for sound input from a user, the echo microphone being directly connected to the speaker. An echo switch may be provided adjacent to the echo microphone to selectively operate the echo microphone.

As well, a connection rod insert hole may be formed in an upper portion of a rear end of the main body, and a connection rod may be fitted into the connection rod insert hole, the connection rod having on an upper end thereof a subsidiary handle, extending a predetermined length in a horizontal direction. The connection rod may be fastened to the main body by fitting a locking pin into a fitting hole through the main body.

Moreover, each of the one-way wheel assemblies may include a wheel shaft, a clutch bearing fitted over the wheel shaft, and a rubber tire provided on a circumferential outer surface of the clutch bearing.

Advantageous Effects

In the present invention, a riding apparatus can be advanced all the while maintaining the original shape of a main body without bending the main body on which a child user sits. Thus, the child user can more pleasantly enjoy the riding apparatus just as if he/she were riding a real horse.

Furthermore, even if the child user sitting on the main body holds a handle and shakes the main body forwards and backwards, the riding apparatus is normally operated without leaning to one side, thus ensuring the stability during operation. In addition, even if an excessive load is applied to the riding apparatus when the front and rear legs of the apparatus are stretched or contracted, support plates withstand the load. Therefore, the main body made of synthetic resin is prevented from being undesirably deformed, so that the riding apparatus can be used for a long time, thereby markedly enhancing the reliability of the product.

In addition, when the child user rides on the main body and holds the handle, the child user naturally touches at least one of a first switch and a second switch which are respectively provided on the opposite ends of the handle. Then, sound information, such as the neighing sound of a horse, the sound of a horse's hooves, a children's song, etc., is output. Therefore, the present invention can continuously stimulate the curiosity of the child user. In the case where the riding apparatus of the present invention has an echo function, the riding apparatus can induce the child user to generate various sounds, thus developing the vocal chords of the child user, and improving his/her pronunciation and confidence.

Moreover, while urban children lacking in exercise are enjoying the play-riding, they can also naturally move for exercise. Therefore, the riding apparatus of the present invention can serve to improve the health of children.

BRIEF DESCRIPTION OF THE DRAWINGS

FIG. 1 is a perspective view of a riding apparatus for children, according to the present invention;

FIG. 2 is an exploded perspective view of the riding apparatus according to the present invention;

FIG. 3 is a perspective view showing an operating unit according to the present invention;

FIG. 4 is a longitudinal sectional view showing the construction of the riding apparatus according to the present invention;

FIG. 5 is a longitudinal sectional view showing the construction of a one-way wheel assembly of the riding apparatus according to the present invention;

FIG. 6 is a view showing the operation of the riding apparatus when it is pushed downwards according to the present invention;

FIG. 7*a* is a schematic view illustrating the operation of a rear leg and an interlocking shaft according to the present invention, and FIG. 7*b* is an imaginary view for illustrating the rotation of the interlocking shaft of the rear leg according to the present invention;

FIG. 8 is a longitudinal sectional view of the riding apparatus when it is moved into the downward state according to the present invention;

FIG. 9 is a view showing the operation of the riding apparatus when it is moved upwards according to the present invention;

FIG. 10 is a plan view showing a sound output unit provided in the riding apparatus according to the present invention;

FIG. 11 is a block diagram showing the construction of the sound output unit used in the present invention; and FIG. 12 is a partially exploded perspective view illustrating another embodiment of the present invention.

BEST MODE FOR CARRYING OUT THE INVENTION

Hereinafter, preferred embodiments of the present invention will be described in detail with reference to the attached drawings.

FIG. 1 is a perspective view of a riding apparatus for children, according to the present invention. FIG. 2 is an exploded perspective view of the riding apparatus. FIG. 3 is a perspective view showing an operating unit. FIG. 4 is a longitudinal sectional view of the riding apparatus. FIG. 5 is a longitudinal sectional view of a one-way wheel assembly of the riding apparatus.

Referring to FIGS. 1 through 4, the riding apparatus 100 for children according to the present invention includes a main body 110, which has an animal or a shape of a popular character, and a handle 111, which is provided on the upper portion of the front end of the main body 110.

The main body 110 is divided into two body parts based on the longitudinal center line thereof. To manufacture the main body 110, the two body parts are formed through injection molding processes and, thereafter, in an assembly process, the two body parts are coupled to each other using coupling members, such as several bolts 116 and nuts 116'. A method of coupling the two body parts to each other using the coupling members to form the main body 110 is easily derived from a well-known technique, therefore detailed explanation and illustration thereof in the drawings will be skipped. As necessary, the two body parts may be fastened to each other by another coupling method.

Two front legs 210 and two rear legs 220 are respectively provided on the lower portions of the front and rear ends of the main body 110. The front legs 210 and the rear legs 220 are rotatably coupled at the upper ends thereof to the main body 110 such that the lower ends thereof can be moved in opposite directions.

Furthermore, the one-way wheel assemblies 211 and 221 are provided in the lower ends of the front legs 210 and the rear legs 220, respectively. The one-way wheel assemblies 211 and 221 are allowed to rotate only in the direction in which the riding apparatus 100 is advanced, and are prevented from rotating in the direction in which the riding apparatus 100 is moved backwards. The one-way wheel assemblies 211 and 221 will be explained in detail later herein.

A plurality of support plates 120 is installed in the main body 110 in an upright position. The operating unit 300, which operates the front legs 210 and the rear legs 220, is provided between the support plates 120.

When the two body parts of the main body 110 are fastened to each other using the bolts 116 and the nuts 116', and at the same time the support plates 120 are fastened to the main body 110 by the bolts 116 and the nuts 116'. At this time, the support plates 120 are brought into close contact with the inner surface of the main body 110. The main body 110 is made of synthetic resin and is formed through an injection molding processes. The support plates 120 are made of metal plates, such as steel plates.

As shown in FIG. 3, the operating unit 300 includes a front rotary member 330 and a rear rotary member 340, which are respectively disposed at front and rear positions. Interlocking shafts 213 and 223 are respectively fitted into insert holes 331 and 341 which are formed through the front rotary member 330 and the rear rotary member 340. Here, preferably, the interlocking shafts 213 and 223 are respectively fastened to the front rotary member 330 and the rear rotary member 340 by welding, but, as necessary, the fastening of the interlocking shafts 213 and 223 may be realized by other fastening means.

Furthermore, a connection bar 310 is coupled at opposite ends thereof to the upper end of the front rotary member 330 and the lower end of the rear rotary member 340 using hinge shafts 320 and 321, respectively.

The front rotary member 330 and the rear rotary member 340 respectively have in the upper ends thereof spring locking holes 332 and 342 and respectively have in central portions thereof guide slots 333 and 343 for defining rotation ranges of the rotary members.

In the process of assembling the riding apparatus 100, stop protrusions 123, which are respectively provided at front and rear positions on the inner surface of one support plate 120, are inserted into the respective guide slots 333 and 343.

Thus, when the front rotary member 330 and the rear rotary member 340 are rotated by the rotation of the interlocking shafts 213 and 223, the guide slots 333 and 343 are rotated relative to the stop protrusions 123, which are fixed at the original positions thereof. Here, the ranges, within which the front rotary member 330 and the rear rotary member 340 are rotated, are respectively determined by the lengths of the guide slots 333 and 343.

With regard to the guide slots 333 and 343 and the stop protrusion 123 having the above-mentioned functions, even if the front rotary member 330 and the rear rotary member 340 are manipulated to attempt rotation beyond the normal rotating ranges, for example, by an excessive load or malfunction of the apparatus, because each stop protrusion 123 comes into contact with the inner surface of one end of the corresponding guide slot 333, 343, the front rotary member 330 and the rear rotary member 340 can rotate no further than that.

Therefore, even if the riding apparatus malfunctions while an infant or a child rides on the main body 110 and plays on the riding apparatus, safety hazards, such as an accident in which the main body 110 falls onto the ground, are prevented by reason of the structure of the apparatus.

Referring to FIGS. 2 and 4, to install the operating unit 300 in the apparatus, the interlocking shaft 213 of the front rotary member 330 is inserted into insert holes 121 and 112, which are respectively formed in the support plates 120 and the main body 110, and, thereafter, the opposite ends of the interlocking shaft 213 are fitted into and fastened to respective shaft holes 214 of the front legs 210.

Furthermore, the interlocking shaft 223 of the rear rotary member 340 is inserted into insert holes 122 and 113, which are respectively formed in the support plates 120 and the main body 110, and, thereafter, the opposite ends of the interlocking shaft 223 are fitted into and fastened to respective shaft holes 224 of the rear legs 210.

The fastening of the interlocking shaft 213 and 223 to the respective shaft holes 214 and 224 may be realized by a key driving method (not shown) and, as necessary, it may be realized by other shaft fastening methods. Such a shaft fastening method is a well-known technique, therefore detailed explanation and illustration thereof are deemed unnecessary.

In the present invention having the above-mentioned construction, when the front legs 210 and the rear legs 220 are rotated, the interlocking shafts 213 and 223 are rotated, thereby rotating the front rotary member 330 and the rear rotary member 340.

Meanwhile, a front spring 350 is coupled to the upper end of the front rotary member 330 to elastically pull the upper end of the front rotary member 300 such that it is biased towards the front end of the main body 110 (that is, in the outward direction).

In detail, the front spring 350 is coupled at a first end thereof to a spring locking protrusion 124, which protrudes inwards from the inner surface of one support plate 120. A second end of the front spring 350 is coupled to a spring locking hole 332 of the front rotary member 330. Thus, the upper end of the front rotary member 330 is always biased in the forward direction owing to the elastic force of the front spring 350.

Furthermore, a rear spring 351 is coupled to the upper end of the rear rotary member 340 to elastically pull the upper end of the rear rotary member 300 such that it is biased towards the rear end of the main body 110 (that is, in the outward direction). A spring tension adjusting unit 360 for adjusting the tension of the rear spring 351 is coupled to the rear spring 351.

Referring to FIG. 4, the spring tension adjusting unit 360 includes a support member 361, which is fastened to the inner surface of one support plate 120 and has a stop piece 361*a* therein, and a wrench bolt 363, an external threaded part of which is inserted through the stop piece 361*a*, and a head part of which is locked to the stop piece 361*a*.

The spring tension adjusting unit 360 further includes a tension adjusting movable body 362, which has in a first end thereof a nut hole 362*a*, into which the external threaded part of the wrench bolt 363 is threaded. The rear spring 351 is connected between the upper end of the rear rotary member 340 and a second end of the tension adjusting movable body 362.

In addition, the head part of the wrench bolt 363 is supported by the stop piece 361*a*, and the tension adjusting movable body 362 is placed in the support member 361 such that it cannot be rotated with respect to the support member 361. Therefore, when rotating the wrench bolt 363 using a tool, such as a wrench, the wrench bolt 363 remains in place while rotating. At this time, the tension adjusting movable body 362 having the nut hole 362*a* is linearly moved.

In detail, when the wrench bolt 363 is rotated in a counterclockwise direction, the tension adjusting movable body 362 is moved upwards and backwards. In contrast, when the wrench bolt 363 is rotated in a clockwise direction, the tension adjusting movable body 362 is moved downwards and forwards. When the tension adjusting movable body 362 is moved upwards and backwards, the rear spring 351 is extended, thus increasing elastic force with which the rear rotary member 340 is pulled. When the tension adjusting movable body 362 is moved downwards and forwards, the rear spring 351 is contracted, thus reducing elastic force with which the rear rotary member 340 is pulled. The tension of the rear spring 351 is adjusted by this method.

To enjoy the play-riding, a user holds the handle 111 and places his/her feet on respective footrests 115, which are provided on the respective sidewalls of the main body 110. Thereafter, the user, who sits on the main body 110, lifts his/her hips and moves the hips downwards to push the main body 110. Then, the main body 110 is moved downwards. Simultaneously, the rear rotary member 340 is rotated in one direction. Thereby, the rear spring 351 is extended.

If the tension of the rear spring 351 is increased, when enjoying the play-riding, the user must push the main body 110 downwards more strongly. If the tension of the rear spring 351 is reduced, the main body 110 can be moved downwards even by relatively small force, with which the main body 110 is pushed by the hips of the user. Therefore, before enjoying the play-riding, the tension of the rear spring 351 is preferably adjusted according to the age or weight of the child user sitting on the main body 110, such that the child user can better enjoy the play-riding.

FIG. 5 is a longitudinal sectional view showing the construction of the one-way wheel assembly 211 or 221 used in the present invention. Each one-way wheel assembly 211, 221 includes a wheel shaft 21, which is provided in each of the front legs 210 and the rear legs 220, a clutch bearing 22, which is fitted over the wheel shaft 21, and a rubber tire 23, which is provided on the circumferential outer surface of the clutch bearing 22 and provides a high frictional force to prevent slipping when it rolls on the ground P.

The clutch bearing 22 is constructed such that balls 22*a* are locked to corresponding stoppers 22*b* when the one-way wheel assembly is rotated in one direction, so that the one-way wheel assembly can rotate only in a counterclockwise direction, when seen in FIG. 5, in other words, it cannot rotate in a clockwise direction. The clutch bearing 22 having the above-mentioned structure is derived from a well-known technique, therefore further explanation is deemed unnecessary.

The operation of the riding apparatus for children according to the present invention will be explained herein below with reference to FIGS. 4 and 6 through 9.

A child user steps on one footrest 115 and sits on the main body 110. In this state, as shown in FIG. 4, the front legs 210 and the rear legs 220 maintain almost vertically placed states.

Subsequently, when the child user sitting on the main body 110 and holding the handle 111, lifts his/her hips and moves the hips downwards to push the main body 110 downwards by the downward pushing force, the riding apparatus, which had been in the state of the dotted and dashed line of FIG. 6, enters the state of the solid line of FIG. 6. At this time, pushing force is applied to the riding apparatus such that the front legs 210 and the rear legs 220 are moved away from each other.

However, here, because the one-way wheel assemblies 211 and 221 can rotate only in the direction in which the riding apparatus advances, the one-way wheel assemblies 221 of the rear legs 220 are not rotated and are thus prevent the main body from being moved backwards. That is, as shown in FIG. 6, the one-way wheel assemblies 221 remain at the point R1, which is their original contact position with the ground P. On the other hand, the one-way wheel assemblies 211 of the front legs 210 roll and thus move the main body forwards.

The front legs 210 and the rear legs 220 are operated at the same time, but, for descriptive purpose, the operation of the front legs 210 will be first explained, before explaining the operation of the rear legs 220.

Referring to FIG. 6, when the main body 110 is moved downwards by the vertical pushing force, the one-way wheel assemblies 211 of the front legs 210 are rotated forwards and thus move from the original position of the point F1 to the point F2. As a result, the one-way wheel assemblies 211 are advanced forwards by a distance L.

Therefore, the front legs 210 enter a state of being moved away from the rear legs. Thereby, the interlocking shaft 213 is rotated in a clockwise direction.

Then, the front rotary member 330, which is firmly fitted over the interlocking shaft 213, is also rotated in a clockwise direction. Thus, the front spring 350 is pulled and extended and, simultaneously, the connection bar 310 pushes the lower end of the rear rotary member 340.

Meanwhile, when the main body 110 is moved downwards by the vertical force, the one-way wheel assemblies 221 of the rear legs 220 maintains the stationary state at the point R1 of FIG. 6 without any backwards motion. Therefore, the upper ends of the rear legs 220 are rotated downwards along an arc-shaped path around the rear ends of the rear legs 220, which are prevented from moving backwards.

In detail, as shown in FIG. 7*a*, the point R1, at which point the one-way wheel assembly 221 is in contact with the ground P, becomes the center, around which the upper end of the rear leg 220 is rotated along the arc-shaped path. At this time, the one-way wheel assembly 221 does not roll but slightly moves at an angle corresponding to the angle at which the upper end of the rear leg 220 is rotated around the point R1. However, because this movement of the one-way wheel assembly 221 is very slight, it will be disregarded for ease of description.

As the upper ends of the rear legs 220 are rotated along the arc-shaped paths, the interlocking shaft 223 is moved downwards and forwards and is rotated.

FIG. 7*b* is an imaginary view for illustrating the rotation of the interlocking shaft 223. Here, the imaginary line of the drawing denotes the interlocking shaft 223 when the upper end of the rear leg 220 is at the original position before being rotated downwards. The solid line denotes the interlocking shaft 223 when the upper end of the rear leg 220 is in the downward rotated state. From this drawing, it is to be understood that the interlocking shaft 223 is rotated at the angle S.

As such, when the upper ends of the rear legs 220 are rotated downwards, the interlocking shaft 223 is moved forwards and downwards. Furthermore, the main body 110 is moved forwards. Simultaneously, because the interlocking shaft 223 is rotated in a counterclockwise direction, the rear rotary member 340 is also rotated in a counterclockwise direction, so that the rear spring 351 enters a state of being pulled and extended, as shown in FIG. 8.

Here, the connection bar 310 functions to make it possible to rotate the front rotary member 330 and the rear rotary member 340 at the same time. In addition, due to the connection bar 310, the distance that the upper end of the front rotary member 330 moves and the distance that the lower end of the rear rotary member 340 moves are always identical to each other.

Therefore, when the main body 110 is moved upwards or downwards, the front rotary member 330 and the rear rotary member 340 are rotated at the same time, and the upper end of the front rotary member 330 and the lower end of the rear rotary member 340 move the same distance.

Meanwhile, when the child user who is riding the apparatus lifts his/her hips, the main body 110, which has been moved downwards, is immediately moved upwards.

Referring to FIG. 8, after the main body 110 is moved downwards, the front rotary member 330 and the rear rotary member 340 are rotated in clockwise directions by the restoring force of the front and rear springs 350 and 351, which have been extended. Thereby, the interlocking shafts 213 and 223 are also rotated in clockwise directions.

Therefore, the lower ends of the front legs 210 are biased inwards, that is, in the direction approaching the rear legs 220, but, because the one-way wheel assemblies 211 of the front legs 210 are constructed such that they can rotate only forwards, the one-way wheel assemblies 211 remain at the point F1 without rolling backwards.

Thus, the upper ends of the front legs 210 are moved upwards along arc-shaped paths, and the main body 210 is moved forwards.

At this time, in the rear legs 220, because the interlocking shaft 223 is rotated in a clockwise direction, the lower ends of the rear leg 220 are rotated in a clockwise direction around the interlocking shaft 223. Thereby, as shown in FIG. 9, the one-way wheel assemblies 221, which can rotate only forwards, roll forwards and thus move from the point R1 to the point R2. That is, the one-way wheel assemblies 221 are advanced forwards by a distance L.

As such, in the present invention, one cycle, in which the main body 110 is moved downwards and then automatically moved upwards by the elastic force of the front and rear springs 350 and 351, is conducted by the motion of the child user who is sitting on the riding apparatus 100 lifting his/her hips and moving the hips downwards. The main body 110 is advanced forwards by a distance L for every cycle.

Therefore, when the child user repeats the one cycle operation, the riding apparatus 100 is continuously advanced forwards. Thus, the child user can enjoy the play-riding and, simultaneously, gain the effects of the exercise involved, because the child user repeatedly moves his/her body upwards and downwards.

Furthermore, in the present invention, the operating unit 300 is installed between and supported by the two support plates 120, which are placed upright in the main body 110. Hence, even though pressure is continuously applied to the front and rear legs 210 and 220, the support plates 120 can sustain the required load applied thereby, thus preventing the main body 110, which is made of plastic, from becoming undesirably deformed, and thereby enhancing the reliability of the product.

In addition, because the front rotary member 330 is coupled to the rear rotary member 340 through the connection bar 310 and they are operated in conjunction with each other, the motion, in which the front legs 210 and the rear legs 220 move away from and approach each other, is always regular and constant. Accordingly, the load is prevented from being focused on one side. Thus, even if the child user who sits on the main body 110 shakes the main body 110 forwards and backwards, the main body 110 is prevented from excessively leaning forwards or backwards and thus prevented from falling over. Rather, the riding apparatus 100 can provide an effect similar to that of riding a horse, thus making play-riding of the riding apparatus more pleasant and enjoyable.

Meanwhile, children typically get tired of all objects quickly. Thus, to induce the child user to enjoy the riding apparatus of the present invention for a long period time, it is preferable that the riding apparatus of the present invention have a variety of functions.

To achieve the above-mentioned purpose, the riding apparatus 100 of the present invention may have a function of generating music or voice. FIG. 10 is a plan view showing a riding apparatus provided with a sound output unit according to the present invention. FIG. 11 is a block diagram showing the system of the sound output unit used in the present invention.

Referring to FIGS. 10 and 11, the sound output unit 400 is provided in the upper portion of the main body 110. The sound output unit 400 includes a speaker 401, an internal memory device 402, a removable external memory device 403, a microprocessor 404 and a battery 405. Furthermore, a first switch 406 for outputting sound information, stored in the internal memory device 402, and a second switch 407 for outputting sound information, stored in the removable external memory device 403, are provided on the respective opposite ends of the handle 111.

Furthermore, an echo microphone 408, which provides an echoing effect for sound input from a user, is provided at a predetermined position in the main body 110. The echo microphone 408 is directly connected to the speaker 401. An echo switch 409 for selectively operating the echo microphone 408 is provided adjacent to the echo microphone 408.

Preferably, a touch switch, which alternately turns on or off the sound output operation each time the user touches it, is used for each of the first and second switches 406 and 407. Furthermore, a memory car type is preferably used as the removable external memory device 403. This sound output unit 400 is derived from a well-known technique, therefore detailed explanation of a circuit thereof will be skipped.

When the child user rides on the riding apparatus 100, he/she naturally holds the handle 111 for the sake of safety. At this time, because the first switch 406 and the second switch 407 are respectively provided on the opposite ends of the handle 111, the child user naturally touches the first switch 406 or the second switch 407 using his/her left or right hand.

In the case where the first switch 46 is touched by the child user, various sounds stored in the internal memory device 402 of the sound output unit 400 are output through the speaker 401. For example, if the neighing sound of a horse and the sound of horses' hooves are stored in the internal memory device 402, when the child user touches the first switch 406, the horse's neighing sound and the sound of horses' hooves are loaded by the microprocessor 404 and are output through the speaker 401. Thus, the child user can enjoy the riding apparatus as if he/she were riding a real horse.

In the case where the child user touches the second switch 407, sound information stored in the removable external memory device 403 is output. For example, it is more preferable that a child's favorite song or the like be stored in the removable external memory device 403, so that when the child user touches the second switch 407, the child's song is output.

When the child user pushes the echo switch 409, sounds generated from the child user are output using an echo effect. This echo function induces the child user to generate many sounds out of curiosity. Therefore, the present invention having the echo function can develop the vocal chords of the child user and promote the confidence and the language of the child user.

FIG. 12 is a partially exploded perspective view illustrating another embodiment of the present invention. In this embodiment, a connection rod insert hole 117 is formed in the upper portion of the rear end of the main body 110. A connection rod 500 is fitted into the connection rod insert hole 117. The connection rod 500 has on the upper end thereof a subsidiary handle 501, which extends a predetermined length in a horizontal direction. A locking pin 114 is inserted through a hole, which is formed in the main body 110, and is fitted into a fitting hole 502, which is formed in the connection rod 500.

In normal conditions, the connection rod 500 is separated from the main body 110 and is separately stored. When necessary, for example, when play-riding for a relatively long distance, going for a walk or using the riding apparatus in a place such as a large store, where many people are, the connection rod 500 may be selectively mounted to the rear end of the main body 110.

In the case where the connection rod 500 is mounted to the rear end of the main body 110, a guardian may hold the subsidiary handle 501 and push the riding apparatus. In this case, the riding apparatus 100 can be used as a baby carriage. Therefore, the riding apparatus of the present invention allows the guardian to go outdoors with the child riding the apparatus, thus being convenient for the guardian, and being very useful.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A riding apparatus for children, comprising:

a main body (110) having an animal or character shape, the main body (110) being divided into two body parts manufactured through separated processes, the main body (110) being formed by coupling the two body parts to each other, with a handle (111) provided on an upper portion of a front end of the main body (110), and a footrest (115) provided on a lower end of a medial portion of the main body (110);

a plurality of support plates (120) installed in the main body (110), the support plates (120) being placed upright at positions spaced apart from each other by a predetermined distance;

an operating unit (300), comprising: a front rotary member (330) and a rear rotary member (340) respectively having interlocking shafts (213) and (223), the interlocking shafts (213) and (223) being respectively inserted into insert holes (121), (112) and (122), (113), which are formed at front and rear positions in the support plates (120) and the main body (110), so that the front rotary member (330) and the rear rotary member (340) are respectively provided at front and rear positions between the support plates (120) so as to be rotatable, with guide slots (333) and (343) respectively formed in central portions of the front rotary member (330) and the rear rotary member (340), so that stop protrusions (123), which are respectively provided at front and rear positions on an inner surface of one of the support plates (120), are inserted into the respective guide slots (333) and (343); a front spring (350) for applying an elastic force to the front rotary member (330) such that an upper end of the front rotary member (330) is biased forwards; a rear spring (351) for applying an elastic force to the rear rotary member (340) such that an upper end of the rear rotary member (340) is biased backwards; and a connection bar (310) coupled to the upper end of the front rotary member (330) and a lower end of the rear rotary member (340) using hinge shafts (320) and (321), respectively; and a pair of front legs (210) and a pair of rear legs (220) respectively having shaft holes (214) and (224) fitted over corresponding opposite ends of the interlocking shafts (213) and (223) which extend outside the main body (110) through the insert holes (112) and (113), with one-way wheel assemblies (211) and (221) respectively provided on lower ends of the front legs (210) and the rear legs (220), each of the one-way wheel assemblies (211) and (221) being rotatable only in a forward direction, the front legs (210) and the rear legs (220) being swung in directions away from each other and in directions approaching each other.

2. The riding apparatus for children according to claim 1, further comprising:

a spring tension adjusting unit (360) for adjusting a tension of the rear spring (351), which biases the upper end of the rear rotary member (340) backwards, the spring tension adjusting unit (360) comprising: a support member (361) provided on an inner surface of one of the support plates (120), the support member (361) having a stop piece (361*a*) therein; a tension adjusting movable body (362) provided in the support member (361) so as to be linearly movable, with a nut hole (362*a*) formed through a first end of the tension adjusting movable body (362), the tension adjusting movable body (362) being coupled at a second end thereof to the rear spring (351); and a wrench bolt (363) inserted into the stop piece (361*a*) and threaded into the nut hole (362*a*), so that the tension adjusting movable body (362) is linearly moved by rotating the wrench bolt (363), thus adjusting the tension of the rear spring (351).

3. The riding apparatus for children according to claim 1, wherein a sound output unit (400) is provided in the upper portion of the front end of the main body (110), the sound output unit (400) comprising a speaker (401), an internal memory device (402), a removable external memory device (403), a microprocessor (404) and a battery (405), and wherein a first switch (406) for outputting sound information, stored in the internal memory device (402), and a second switch (407) for outputting sound information, stored in the removable external memory device (403), are respectively provided on opposite ends of the handle (111).

4. The riding apparatus for children according to claim 3, wherein an echo microphone (408) is provided at a predetermined position in the main body (110) to provide an echoing effect for sound input from a user, the echo microphone (408) being directly connected to the speaker (401), and an echo switch (409) is provided adjacent to the echo microphone (408) to selectively operate the echo microphone (408).

5. The riding apparatus for children according to claim 1, wherein a connection rod insert hole (117) is formed in an upper portion of a rear end of the main body (110), and a connection rod (500) is fitted into the connection rod insert hole (117), the connection rod (500) having on an upper end thereof a subsidiary handle (501), extending a predetermined length in a horizontal direction, wherein the connection rod (500) is fastened to the main body (110) by fitting a locking pin (114) into a fitting hole (502) through the main body (110).

6. The riding apparatus for children according to claim 1, wherein each of the one-way wheel assemblies (211) and (221) comprises a wheel shaft (21), a clutch bearing (22) fitted over the wheel shaft (21), and a rubber tire (23) provided on a circumferential outer surface of the clutch bearing (22).

* * * * *